United States Patent [19]

Knights et al.

[11] 4,151,696

[45] May 1, 1979

[54] FRAMED WINDOW PANELS

[75] Inventors: Richard N. Knights, Gloucester; Anthony Wilson, Weston-Super-Mare, both of England

[73] Assignee: Rivers Machinery Limited, Winchester, United Kingdom

[21] Appl. No.: 860,992

[22] Filed: Dec. 15, 1977

[51] Int. Cl.[2] ..... E04B 1/62

[52] U.S. Cl. ..... 52/741; 52/397; 52/475; 52/743

[58] Field of Search ..... 52/616, 397, 398, 741, 52/475, 400, 627, 628, 399, 717, 656, 743

[56] References Cited

U.S. PATENT DOCUMENTS

| | | | |
|---|---|---|---|
| 2,304,423 | 12/1942 | Schiller | 52/628 X |
| 2,741,809 | 4/1956 | Englehart et al. | 52/628 X |
| 3,852,149 | 12/1974 | Sitter et al. | 52/616 X |

FOREIGN PATENT DOCUMENTS

| | | | |
|---|---|---|---|
| 121291 | 4/1946 | Australia | 52/627 |

*Primary Examiner*—Price C. Faw, Jr.
*Assistant Examiner*—Carl D. Friedman
*Attorney, Agent, or Firm*—Young & Thompson

[57] ABSTRACT

A glazed window frame, including a glazing panel set into a frame of channel shaped metal members with an elastomeric sealing material occupying each channel and engaging the two faces of the glass panel, the side flanges of the channel being formed or provided with means to limit or prevent escape of the sealing material from the channel.

6 Claims, 10 Drawing Figures

FRAMED WINDOW PANELS

Figure 1:
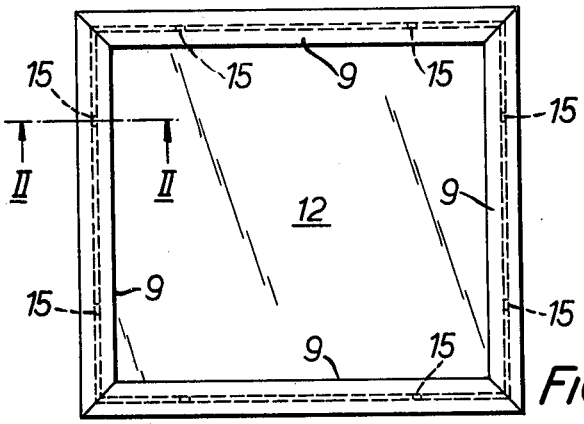

This invention relates primarily to the construction of glazed window frames but is also applicable to frames for other types of panel.

It is common practice in the construction of glazed window frames to provide a sealing strip around the edge of the glazing, the strip being pressed tightly into a channel provided by the frame so as to provide both a seal and a bedding for the glazing in the frame. These sealing strips are normally of channel or U-shaped in cross section, and are formed of a soft pliable synthetic plastics material. Although satisfactory from many view points such sealing strips can be time consuming, awkward and expensive to install, and it is an object of the invention to provide an improved method of constructing a glazed window frame or panel without the need for such a sealing strip. A particular advantage of the invention is that it enables the fabrication of glazed frames to be carried out on a semi or fully automatic basis.

Broadly stated the invention consists in a method of constructing a framed panel, such as a window frame, in which a plurality of frame members each providing an inwardly facing channel as assembed around a panel with the edges of the panel lying in the channels, and in which a viscous sealing material is introduced into each channel to provide a seal and to locate the edge of the panel, and means are provided to prevent or limit the flow of excess sealing material from the channels.

Preferably the sealing material is introduced into gaps between the faces of the panel and the side flanges of the channels, and according to a particular preferred feature the sealing material is viscous when introduced, and is then caused or allowed to become more solid though elastomeric, when in position. For example the sealing material may be a two-part curable synthetic resin, polymer or rubber, or it may be softened by heat, and then allowed to cool in position.

In preferred forms of the invention the sealing material is injected into the channel of each frame member before the panel is introduced into the channel, and additional quantities of the sealing material may be injected at the corners of the frame.

It is of advantage for each channel to be provided with a resilient gasket or sealing member along each of its side flanges to engage the adjacent face of the panel and prevent or restrict escape of the sealing material therefrom.

From another aspect the invention consists in a framed panel, comprising a number of elongated frame members joined together at the corners of the frame, and each providing an inwardly directed channel around the frame, and a panel or glazing sheet located with its edges lying in the channel, with a sealing material located in the gap between the channel of the frame and the edges of the panel, and also engaging both faces of the panel, and including means on the channel flanges for limiting or preventing escape of the sealing material.

The invention also consists in apparatus for making a framed panel, including means for locating the panel, means for introducing the sealing material into the channels of the frame members, means for shifting the frame members towards and over the edges of the panel, and for closing the ends of the frame members against each other to provide a complete frame.

Figure 2:
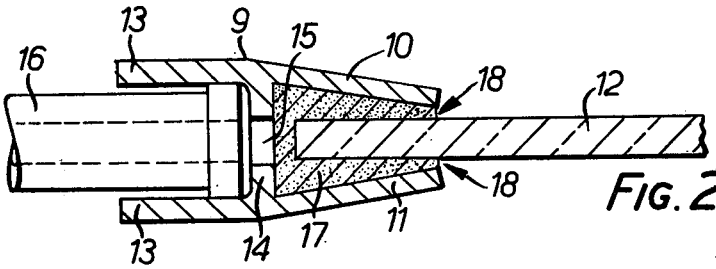
Figure 3:
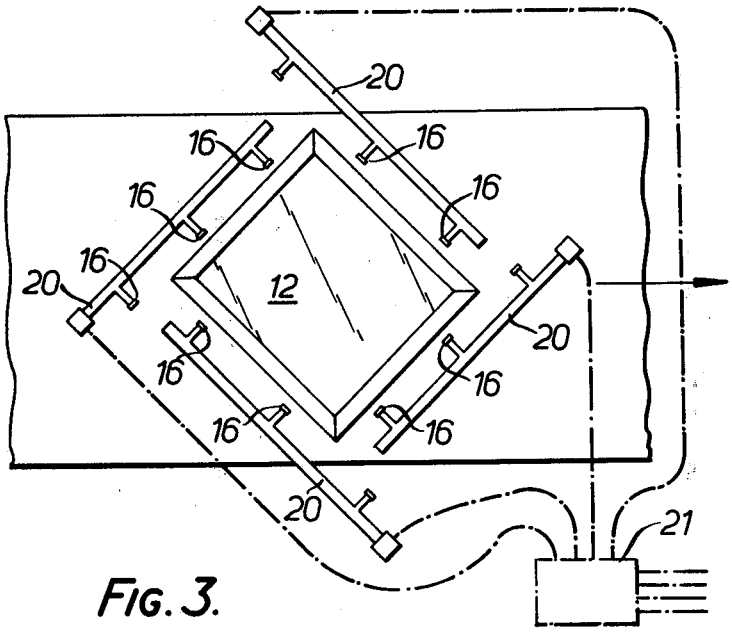
Figure 4:
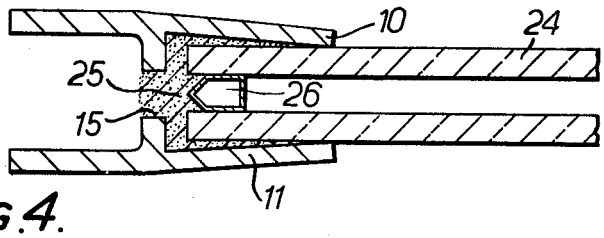
Figure 5:
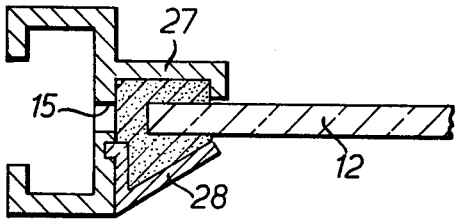
Figure 6:
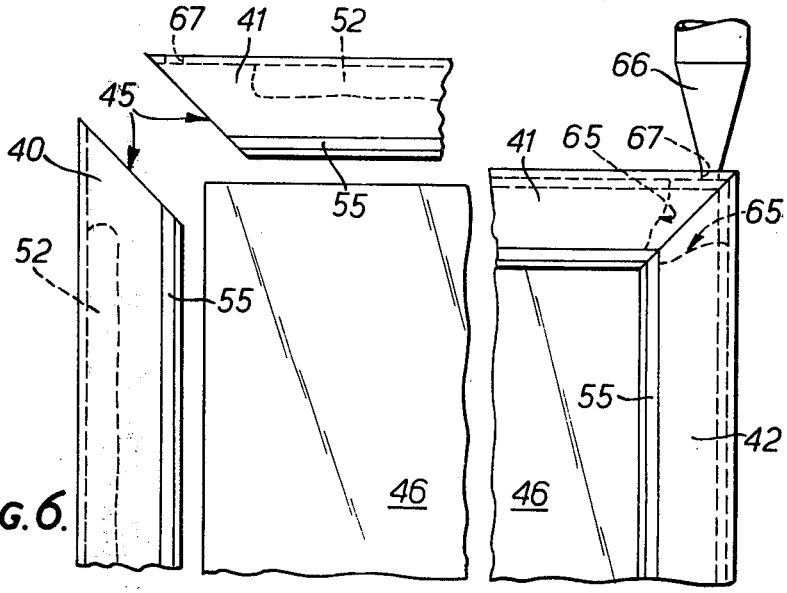
Figure 7:
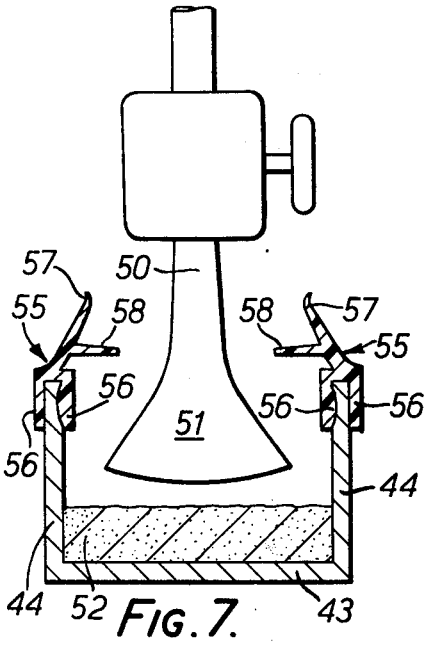
Figure 8:
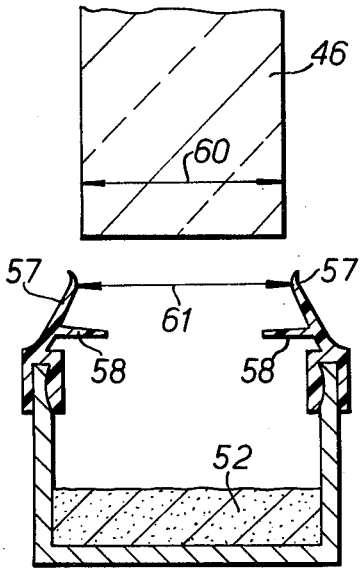
Figure 9:
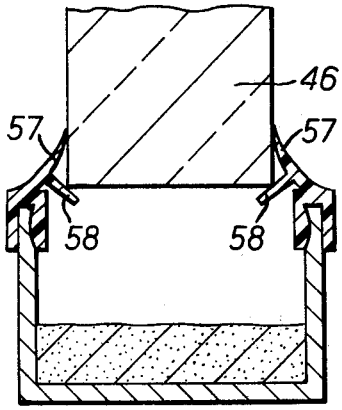
Figure 10:
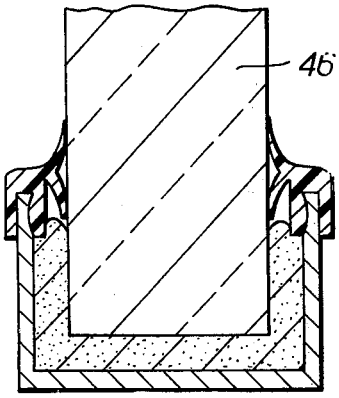

The invention may be performed in various ways and some specific embodiments will now be described by way of example with reference to the accompanying drawings in which;

FIG. 1 is a diagrammatic front view of a glazed window frame to which the invention may be applied, FIG. 2 is a cross section through the frame on the line II—II in FIG. 1, FIG. 3 is a plan view of an assembly station illustrating the location of the pressure injection nozzles around the frame, FIG. 4 is a cross section, similar to FIG. 2, of a modification applied to a double glazed frame, FIG. 5 is another cross section illustrating a further embodiment where the channel of the frame is formed by a separate glazing bar, FIG. 6 is a diagrammatic plan view illustrating stages in the assembly of a modified glaze window frame according to the invention, FIG. 7 is a cross section through one of the frame bars of FIG. 6 illustrating the injection of the sealing material into the channel, FIG. 8 is a similar cross section illustrating the relative positions before the glass is engaged in the channel, FIG. 9 illustrates a further stage in which the edge of the glass has started to enter the channel, and FIG. 10 is another cross section illustrating the glass fully engaged with the sealing material within the channel.

Referring first to FIG. 1 it will be seen that the frame is constructed of four straight frame members 9 mitred at their ends to form the corners. The corners may or may not also include internal reinforcing brackets. A typical cross section through one of the members is illustrated in FIG. 2, the member in this case being an extruded aluminium bar which has two generally parallel flanges 10, 11 providing an inwardly facing channel to receive the glazing sheet 12. The frame member also has a pair of smaller external flanges 13 and includes a web 14 between the two channels. In accordance with the invention this web is drilled out at a number of positions 15, one, two or more in each frame member as illustrated in FIG. 1.

In constructing the glazed frame the glazing sheet or pane 12 is introduced into position before the four frame members 9 have been finally assembled, and after the frame members have been brought together and secured at the four corners a number of injection nozzles as illustrated at 16 in FIG. 3 are moved inwardly to enter between the flanges 13 and line up with the apertures 15. A semi-fluid viscous sealing material is then injected at a controlled pressure to penetrate through the apertures 15 into the cavity 17 formed by the inward facing channel. The viscous sealing material penetrates lengthwise along the cavity 17 and also parallel to the plane of the glazing sheet 12. The flanges 10 and 11 are bent or inclined inwardly as indicated in FIG. 2 to provide restricted gaps 18 between the lips of the flanges and the glazing sheet, and by normal manufacturing methods it is possible to control this gap width to within acceptable fine limits.

The viscous sealing material composition is carefully selected and formulated to be sufficiently fluid for the necessary movement and penetration along the cavities in the frame but sufficiently viscous to avoid excessive waste at the gaps. For example the material may be thixotropic, or air hardening, or it may be heated to near its softening temperature, or in general carefully selected in relation to the dimensions of the gaps to provide the required result. The behaviour of the material also depends partly upon the pressure applied at the nozzles and the apparatus for injecting the material preferably includes pressure sensors at the nozzles themselves or connected to the frame cavity, and arranged to control the injection pressure automatically so as to avoid unnecessary escape of the material through the gaps 18.

One particular preferred sealing material is a two component polysulphide sealant, including a manganese dioxide oxidising agent. This has excellent adhesive properties and moisture resistance and considerable tensile and compressive strength. Its hardness after curing is about 50–60 Shore A, and its curing time at 25° C. is one hour or more to reach a tackfree rubber state. Before curing the viscosity is such that a flow of 20 grams can be made in less than 10 seconds through an orifice measuring 0.104", at 40 lb/sq.in. The curing time is approximately halved for every 10° C. increase in the curing temperature up to 50° C. when the curing time is approximately 1 minute.

Another useful sealing material is a single component silicone rubber which also has excellent adhesive and moisture resistant properties and good tensile and compressive strength. In its uncured state it has a viscosity resembling a soft paste and it reaches tackfree conditions in approximately 1 hour.

A third possible sealing material is a single component hot melt butyl ribber with synthetic polymers and elastomers. This has good adhesive and moisture resistant properties and when heated to about 180° C. it has a viscosity of 750,000 centipoises and a curing time of about three minutes.

These sealing materials are all suitable to be applied to the channels of the frame members and in their final cured solidified state they provide a firm resilient support for the glazing.

FIG. 3 illustrates an automatic assembly station in which pairs, or multiples of injection nozzles 16 are mounted on movable bars 20, all connected to a common injection supply pump unit 21. There may also be pneumatic Jacks 22 for holding the nozzle bars firmly against the frame. This arrangement allows the same injection equipment to be used for frames of different sizes.

In FIG. 4 the frame is of the same basic construction as FIG. 2, but the channel is of somewhat larger dimensions to accomodate a double glazing unit 24. In this case the sealing material 25 not only beds and seals the glazing unit in the frame, but also provides a seal around the usual double glazing spacer bar 26.

In the further form of frame illustrated in FIG. 5 the construction is again basically as illustrated in FIG. 1 and 2, but the channel to locate the glazing sheet is formed partly by a flange 27 integral with the frame member, and partly by a separate removable glazing bar 28. With this arrangement it is possible to replace a broken glazing sheet by removing the bars 28, without dismantling the whole frame.

In the further example of the invention illustrated in FIGS. 6 to 10 sealing composition is injected into the channels of the surrounding frame before the edges of the glass panel have been introduced into position. As illustrated in FIG. 6 the individual frame bars 40, 41 and 42 are each of channel shape having a web 43 with side flanges 44 and the two ends of each bar are mitred at 45° as indicated at 45. Before the assembly of the frame and the insertion of the glazing 46 a controlled quantity of soft viscous sealing material 52 is introduced into each channel along substantially the whole length. This is performed by means of a metering dispensing nozzle 50 as illustrated in FIG. 7, having a fishtail outlet nozzle 51 which spreads the mastic substance over substantially the full width of the base web 43, and to a height controlled by the volumetric metering setting of the nozzle. Conveniently the nozzle is held stationary while the channel is moved lengthwise at a controlled speed below, but alternatively the channels may be held stationary while the nozzles is moved lengthwise.

It will be noted that the mastic 52 stops short of the mitred ends 45 of the frame bars, for a purpose which will be described below.

Along the upper edge of each of the flange 44 is fitted a resilient synthetic plastic edge gasket 55. Each of these has a pair of lower limbs 56 which provide a channel fitting over the upper edge of the respective flange 44, and each flange may have a groove or rib to locate the gasket against accidental removal. Each gasket also has an upwardly projecting resilient flange 57 which is inclined inwardly across the channel as shown in FIG. 7, and from an intermediate point on the flane 57 a further flange 58 projects horizontally towards the opposite gasket. It will be noted that the tip of the flange 58 projects further horizontally than the tip of the flange 57.

In the assembly and construction of the complete glazed panel the glazing 46 is first located automatically on a table or support and the four frame bars, each with the sealing material in position and the two edge gaskets attached, are located along the four edges of the glazing as illustrated on the left of FIG. 6.

Automatic assembly mechanisms (not illustrated) then move all four frame bars inwards so that the edges of the glazing panel pass between and engage the edge gaskets, and bed into the sealing material as illustrated in FIGS. 8, 9 and 10. In FIG. 8 the glazing 46 is about to contact the edge gaskets 55 and it will be noted that the width 60 of the glazing is somewhat less than the horizontal distance 61 between the upper flanges 57, but is somewhat greater than the distance between the lower flanges 58. As the glazing enters deeper between the gaskets the lower flanges 58 are deflected downwards and cause a general rocking movement of each gasket which brings the upper flange 57 also into engagement with the glazing, as illustrated in FIG. 9. Further movement of the glazing deflects the lower flanges 58 and eventually the edge of the glazing 46 beds into the plastic sealing compound 52 and forces this up the side walls of the channel until it reaches the gaskets, as illustrated in FIG. 10. The lower gasket flanges 58 prevent the sealing material escaping while the upper flanges 57 prevent entry of water. The sealing material is specially selected to be relatively soft and fluid at this stage, but rapidly cures to its final elastomer condition when it adheres strongly to the glass and to the aluminium channel and provides a firm resilient support for the glass.

During this assembly of the frame bars onto the glazing some of the sealing material will rise along the channel flanges, as illustrated in FIG. 10. Some of the material may also be displaced lengthwise towards the mitred ends 45, but the quantity of sealant material introduced is carefully controlled to avoid excess being extruded from the mitred corners. At this stage each of the corners has a void defined by the limiting ends 65 of the sealing material as shown in FIG. 6. In a final stage a sealant injector nozzle 66 is applied to a small aperture 67 provided at one of each pair of mitred frame corner bars, so as to inject just sufficient material to fill this void.

We claim:

1. A method of constructing a framed panel in which a plurality of frame members each providing an inwardly facing channel are assembled around a panel with the edges of the panel lying in the channels, and in which a viscous sealing material is introduced into each channel to provide a seal and to locate the edge of the panel, each channel being provided with a resilient sealing member along each of its side flanges to engage the adjacent face of the panel and limit escape of the sealing material therefrom.

2. A method according to claim 1, in which the sealing material is caused to flow into gaps between the faces of the panel and the side flanges of the channels, thus preventing contact betwen the panel and each channel.

3. A method according to claim 1, in which the sealing material is viscous when introduced, and is then caused or allowed to become more solid though elastomeric, when in position.

4. A method of constructing a framed panel in which a plurality of frame members each providing an inwardly facing channel are assembled around a panel with the edges of the panel lying in the channels, and in which a viscous sealing material is introduced into each channel to provide a seal and to locate the edge of the panel, the sealing material being injected into the channel of each frame member before the panel is introduced into the channel, and additional quantities of the sealing material being injected at the corners of the frame, and means are provided to prevent or limit the flow of excess sealing material from the channels.

5. A method of constructing a framed panel in which a plurality of frame members each providing an inwardly facing channel are assembled around a panel with the edges of the panel lying in the channels, and in which a viscous sealing material is introduced into each channel to provide a seal and to locate the edge of the panel, the sealing material being injected at a plurality of points around the frame after the panel has been located with its edge lying within the channels of the frame members, and means being provided to prevent or limit the flow of excess sealing material from the channels.

6. A framed panel, comprising a number of elongated frame members joined together at the corners of the frame, and each providing an inwardly directed channel around the frame, and a panel or glazing sheet located with its edges lying in the channel, with a sealing material located in the gap between the channel of the frame and the edges of the panel, and also engaging both faces of the panel, and in which each side flange of each channel is provided with a resilient sealing strip to engage the adjacent face of the panel and restrict escape of the sealing material.

* * * * *